US008770078B2

(12) United States Patent
Baba et al.

(10) Patent No.: US 8,770,078 B2
(45) Date of Patent: Jul. 8, 2014

(54) SHEET HOLE PUNCHING DEVICE

(75) Inventors: Kenji Baba, Kofu (JP); Yuji Hasebe, Minamialps (JP)

(73) Assignee: Seiko Ltd., Kawasaki-shi (JP)

( * ) Notice: Subject to any disclaimer, the term of this patent is extended or adjusted under 35 U.S.C. 154(b) by 220 days.

(21) Appl. No.: 13/483,769

(22) Filed: May 30, 2012

(65) Prior Publication Data

US 2012/0297950 A1 Nov. 29, 2012

Related U.S. Application Data

(60) Continuation-in-part of application No. 12/923,464, filed on Sep. 23, 2010, now Pat. No. 8,291,802, which is a division of application No. 11/727,940, filed on Mar. 29, 2007, now Pat. No. 7,823,494.

(30) Foreign Application Priority Data

| | | |
|---|---|---|
| Mar. 31, 2006 | (JP) | 2006-100253 |
| Aug. 3, 2006 | (JP) | 2006-212535 |
| Jan. 15, 2007 | (JP) | 2007-005512 |
| Jan. 30, 2007 | (JP) | 2007-019457 |
| Mar. 9, 2007 | (JP) | 2007-060841 |

(51) Int. Cl.
*B26F 1/04* (2006.01)

(52) U.S. Cl.
CPC ..... *B26F 1/04* (2013.01)
USPC ..... 83/618; 83/628; 83/687; 234/94; 408/153

(58) Field of Classification Search
USPC ..... 83/618, 627–629, 631, 632, 684, 686, 83/687, 691; 234/43, 94, 97, 98, 101; 408/87, 153
See application file for complete search history.

(56) References Cited

U.S. PATENT DOCUMENTS

| | | | | | |
|---|---|---|---|---|---|
| 443,766 | A * | 12/1890 | Moran | 408/87 |
| 1,345,395 | A * | 7/1920 | Packheiser | 83/631 |
| 1,421,928 | A * | 7/1922 | Fitzgerald | 408/136 |
| 1,747,240 | A * | 2/1930 | Haupt | 83/354 |
| 2,528,282 | A * | 10/1950 | Melberg | 83/105 |
| 5,676,497 | A * | 10/1997 | Kim | 408/21 |
| 6,540,451 | B1 * | 4/2003 | Mori | 83/629 |
| 6,622,908 | B2 * | 9/2003 | Fukumoto et al. | 234/98 |
| 6,751,874 | B2 * | 6/2004 | Eldar | 30/363 |
| 6,860,478 | B2 * | 3/2005 | Hirai | 83/370 |
| 7,458,505 | B2 * | 12/2008 | Majima et al. | 234/98 |
| 2001/0011492 | A1 * | 8/2001 | Fukumoto et al. | 83/549 |

FOREIGN PATENT DOCUMENTS

| | | | |
|---|---|---|---|
| JP | 2002-326196 | A | 11/2002 |
| JP | 2008137099 | A * | 6/2008 |

* cited by examiner

*Primary Examiner* — Stephen Choi
(74) *Attorney, Agent, or Firm* — Manabu Kanesaka

(57) ABSTRACT

A sheet hole punching device has a device frame bearing-supporting a plurality of punching members, a driving rotation shaft, a drive motor, a gear mechanism transmitting a rotation of the driving rotation shaft, cam mechanisms converting the rotational movement into vertical movement, and a motor control device. The gearing mechanism includes drive gears fixed on the driving rotation shaft and receiving gears to engage with the drive gears to transmit the rotational movement to the punching members. The cam mechanism includes cylindrical cams formed integrally to the punching members and cam followers fixed to the device frame. The cylindrical cams are provided with V-shaped groove cams to reciprocate the punching members between an upper dead point and a lower dead point. The punching members are rotated in one direction to punch holes in a sheet, and subsequently rotated in a reverse direction to punch holes in a following sheet.

7 Claims, 13 Drawing Sheets

Cross-sectional view along the line X-X

Upper standby position

Lower standby position

SHEET HOLE PUNCHING DEVICE

CROSS-REFERENCE TO RELATED APPLICATIONS

The present application is a continuation-in-part application of Ser. No. 12/923,464, filed on Sep. 23, 2010, which is a divisional application of Ser. No. 11/727,940, now U.S. Pat. No. 7,823,494.

BACKGROUND OF THE INVENTION

1. Field of the Invention

The present invention relates to hole punching methods, hole punching devices and finishing apparatuses, such as those used in conjunction with image forming apparatuses, that punch holes in sheets conveyed out from an image forming apparatus such as a copier, printing machine or printer and the like.

2. Description of Related Arts

Generally, hole-punching devices that punch holes in sheets by manually pushing hole-punching members downward into a plurality of sheets, and automatic hole-punching devices that punch holes in sheets conveyed out of a printing machine or copier are well known as office devices for punching holes in sheets, such as paper, for filing. The former is widely known as a device for penetrating sheets by disposing cylindrically shaped punching members that reciprocatingly move up and down, on a frame member that sandwiches sheets. By pressing an operating lever downward, these cylindrically shaped hole-punching members penetrate the sheets thereby punching holes.

On the other hand, the latter method uses a drive motor to push punch members through sequentially conveyed out sheets that are set at a predetermined position. These are often incorporated into other devices. Both types of hole-punching devices can simultaneously punch holes in sheets at 2, 3 and 4 positions of predetermined distances. The number of holes and the distances therebetween are set to a uniform standard.

Conventional devices are disclosed in Japanese Pat. Pub. 2001-9791, 2001-26370, 2000-301492, and 2002-36196. These publications disclose disposing an upper frame and a lower frame at a predetermined distance to sandwich sheets set therebetween. The upper frame supports a plurality of hole-punching members to move in up and down directions; the lower frame is formed with die punches (blade-bearing holes) that conform to the hole-punching members. A device is disclosed that uses a drive motor to move a plurality of hole-punch members in a hole-punching direction to punch holes in predetermined position of sheets. Depending on the standard, the plurality of hole-punching members can be selectively operated to punch two, three, or four holes. Also, the load torque applied to the drive motor is reduced by delaying the operation of the selected plurality of punch members.

For that reason, each of the plurality of punch members is connected to the drive motor via cam means. The Japanese Pat. Pub. 1 engages a follower pin equipped on each of the punch members with a sliding cam having an upside-down V-shaped cam groove. The sliding cam is supported to move along the upper frame. A drive motor pinion is connected to a gear rack integrally formed on a portion of the sliding cam. Japanese Pat. Pub. 2 discloses connecting an eccentric cam to each hole-punching member composed of the same configuration described above. This eccentric cam is installed on a drive shaft disposed parallel to the upper frame. The drive shaft is connected to a drive motor. The eccentric cam of each punch member selectively punches holes in sheets depending on the rotational angle of the drive shaft. At the same time, a time difference is provided to the operation of the selected plurality of punch members to vary the hole-punching timing.

These Japanese Patent publications disclose a structure where the hole-punching members punch holes in a sheet in the process of moving from a top dead center to a bottom dead center of a thrusting direction, by receiving thrusting force in the hole-punching direction from the V-shaped cam or eccentric cam without rotating around a longitudinal axis of rotation.

When selectively moving the plurality of hole-punching members in the hole-punching direction using cam means as described in the aforementioned Japanese Patent publications, the hole-punching members are moved up and down in the shaft direction by engaging a follower pin integrally formed in the punch members with a sliding camas described in Japanese Patent Pub.l. They are also moved up and down by connecting the punch members 40 shaft to an eccentric cam, as described in Japanese Patent Pub. 2. These conventional hole-punching structures have the problems outlined below because hole-punching members are normally formed into a spindle-shape to punch holes in a sheet (or sheet bundle) by a thrusting action that is simply an up and down action.

First, a die having blade-bearing holes is disposed, sandwiching the sheets for the punch members that move up and down. A paper cutting debris box is equipped below the die to collect paper cutting debris generated by punching holes in the sheets. In this conventional hole punching device structure wherein punch members move in the up and down direction in only the thrusting direction, paper cutting debris accumulates directly below the blade bearing holes. If the volume of paper cutting debris increases, there is the possibility that the cuttings can find their way into the device through the blade bearing holes. Particularly, when operating the punch and paper cutting debris accumulates into a pile directly below the punch members, a higher load than what is required is applied to the hole-punching members and an excessive load is applied to the drive motor. These loads can lead to mechanical failure. Also, if paper cutting debris on the die gets inside the device, there is the problem of mis-operation of the sheet sensor inside the device.

Secondly, with the hole-punching structure that punches holes in sheets using the thrusting action in up and down directions, another load is placed on the drive motor because a high shear strength is required to punch holes in the sheets. For that reason, when punching holes in sheets such as plastic film, or thick sheets, there is a large load placed on the drive motor. This means that the device must either have a large-capacity motor, or a high gear reduction ratio is needed to punch holes at low speed. Therefore, such devices have the particular problems of requiring a large drive unit and higher costs associated with punching holes.

SUMMARY OF THE INVENTION

The present invention provides a hole-punching method and hole-punching device that can store large volumes of paper cutting debris without the paper cutting debris entering the device, and without increased loads on the hole-punching blades, when punching holes in sheets such as with punch members.

The present invention further provides a hole-punching device that can punch holes at high speed without reduced shear load when punching holes and at the same time can be configured with a compact and lightweight drive mechanism.

The above mentioned first problem is to punch holes in the sheets by moving the punching members in the punching direction as rotating them by reciprocal rotation of the drive motor. Then, this operation is accomplished by punching holes in the sheets continuously back and forth by reciprocally rotating the punch rotating directions alternately.

Thereby, paper cutting debris is scattered in all directions and are received in a paper cutting debris box. Therefore, the paper cutting debris neither accumulates into a pile directly below the punch members, nor enters to the sheet surface from the punch holes and disperses within the device. Together with this, the paper cutting debris is scattered by reciprocal rotations of the punches, accumulated into the box and are not made full by less punching rotation number.

Further, the above mentioned second problem accomplishes reduction of punching load by moving the punching members (punching action) in the punching direction as rotating the punching members. The hole punching blades are then structured in inclination so that punching holes in the sheets continuously back and forth is reciprocally reversed. The life of the hole punching blades may be thereby lengthened.

The present invention is characterized by transmitting rotation of the drive motor as rotational motion from a driving rotation shaft to plural punching members, conversing rotation of each of the punch members into motion in the punching direction at the same time as rotation by means of the V-shape grooved cam provided between the device frames, executing, when reciprocating a driving rotation shaft within a predetermined angular range, the punching action reciprocating each of the punch members from an upper dead point to a lower dead point and subsequently from the lower dead point to the upper dead point by means of rotation in a going direction as well as rotation in a returning direction, and reversing, when continuously punching holes in the sheets, the rotating directions of the punch members by means of the foregoing and following sheets.

Further, the invention is characterized by integrally securing the cam member to each of the punching members, and disposing the punching members having the integrally V-shaped grooved cams and drive rotating shafts transmitting rotation to the punching members between an upper frame of a channel shaped base frame and a lower frame.

BRIEF DESCRIPTION OF THE DRAWINGS

FIG. 12(*c*) shows the state in which the angular position is separated at −45° direction.

DETAILED DESCRIPTION OF THE PREFERRED EMBODIMENT

[First Embodiment]

Figure 1:
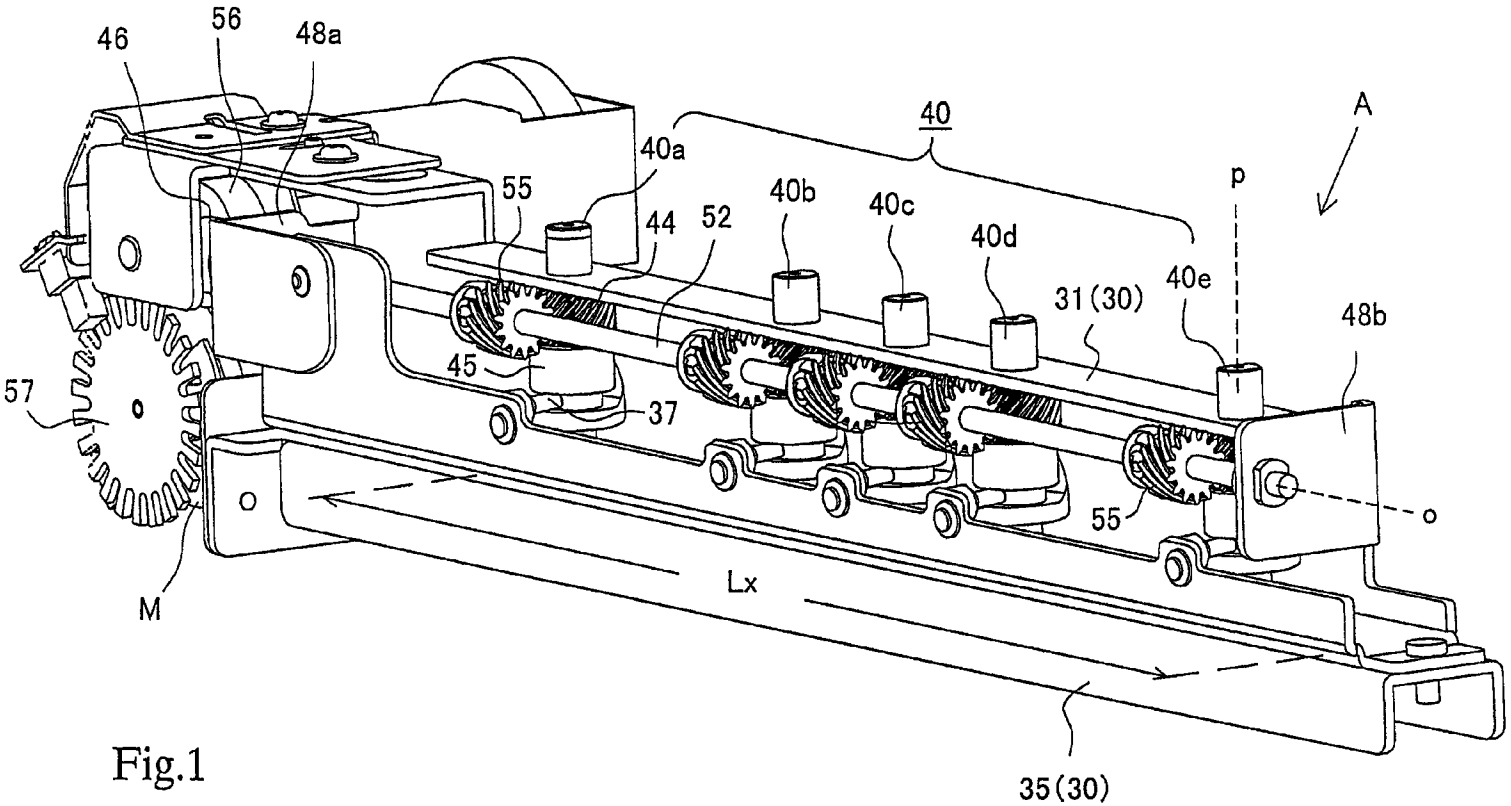
FIG. 1 is an explanatory view showing one embodiment of the hole punching device of paper sheets and the like relating to the present invention, showing a perspective view of the whole of the device.

The sheet hole punching device A in FIG. 1 shows the device structure for punching 2 or 3 holes selectively in the sheets. The sheet hole punching device A is structured with a device frame 30, punching members 40 and a drive means 50.

The device frame 30 is composed with a sheet placing frame 35 and a base frame 31 having the punching members 40. The sheet placing frame 35 is formed to be longer than a sheet width (length crossing with a sheet transferring direction) Lx because placing the sheets.

The sheet placing frame 35 is provided with dice (blade-bearing holes) 38 at positions opposite to later mentioned the punching members 40. Under the sheet placing frame 35, debris boxes 33 are placed to receive paper cutting debris dropping from the dices 38.

A base frame 31 is placed above a space Sd formed in relation with the sheet placing frame 35 for inserting the sheets. In short, the sheet inserting space Sd is formed, and the sheet placing frame 35 is disposed under the space Sd, while the base frame 31 is arranged at its upper part.

On this base frame 31, a plurality of punching members 40*a* to 40*e* are supported on a linear line at predetermined distance in the punching directions (vertical directions in FIG. 1).

Figure 3:
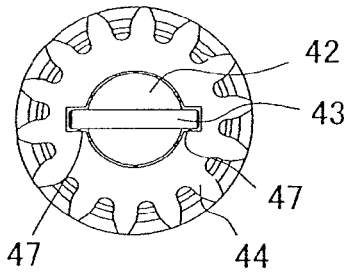
FIG. 3 is the explanatory view of a vertically cross sectional view in the device of FIG. 1.
Figure 3:
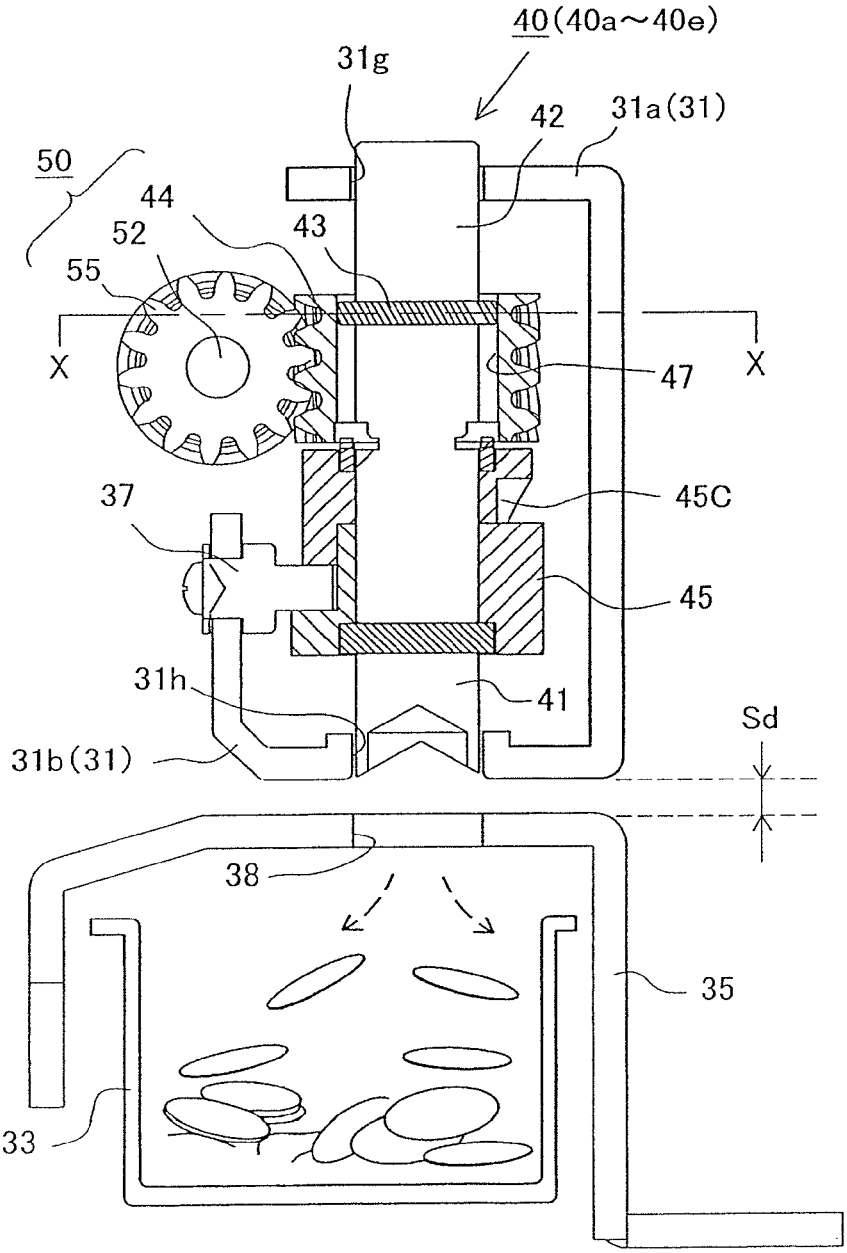

The illustrated base frame 31 is composed with a channel member having a rectangular cross section as shown in FIG. 3, and an upper frame 31*a* and a lower frame 31*b* are disposed in opposition with upper and lower spaces.

In regard to this upper frame 31*a*, later mentioned upper half parts of the punching members 40 are bearing-supported in bearing holes 31*g*.

As is seen, the base frame 31 is not necessarily formed to be rectangular in the cross section, but preferably, the punching members 40 are supported by bearing at upper and lower parts.

The sheet placing frame 35 is, as having mentioned above, provided with the dice (blade-bearing holes) 38, and the paper cutting debris drop downward due to hole punching action of the punching members 40. This sheet placing frame 35 is furnished with the debris boxes 33 into which the paper cutting debris is received.

At this time, in the hole punching mechanism not rotating the punching members 40 but vertically moving only in the hole punching direction, paper cutting debris accumulates directly below the dice 38.

Therefore, even if there still remains a space enabling to accommodate the debris within the debris box, they must be treated as being full so that paper cutting debris partially piling does not scatter within the device.

Since the present invention reversely rotates the punching members 40 and also a rotating direction each time of punching holes in the sheets, paper cutting debris dropping from the die holes 38 is scattered widely in right or left directions. Thus, the debris accommodating capacity of the debris box is made large.

The punching members 40 are composed in plural in response to the punching number, and the illustrated members are composed of five punching members 40*a* to 40*e* of the same structure. Each of the punching members 40 is, as shown in FIG. 3, formed with a hole punching blade 41 at its front and a shaft shaped punch (rod portion) 42 at its base.

A hole punching blade 41 is formed to be sharpened at its endpoint as U-shaped in cross section sloping a cylindrical shape otherwise as reverse V-shaped in cross section slitting the cylindrical shape, and is formed to be shaped with a rotating cutting edge when rotating left and right.

At the same time, the hole punching blade 41 is formed to be reverse V-shaped (FIG. 5(*b*)), reverse U-shaped (FIG. 5(*c*)) or slanting shape (FIG. 5(*d*)).

The hole punching blade 41 serves both shearing force to the sheets in the hole punching direction and in the rotating direction when moving in the punching direction as rotating the punching member 40 in the hole punching direction.

The base end of the punching member 40 is formed to be a punching shaft 42, and this punching shaft 42 is formed to be axis circular in cross section and is axially supported by the base frame 31. In particular, the illustrated punching shaft is circular in cross section and is rotatably fitted in an upper bearing hole 31*g* and a lower bearing hole 31*h*.

Each punching member 40 is furnished with a cylindrical cam (cam means) 45 and a receiving gear 44 rotating and concurrently driving the hole punching blade 41 by rotation of the drive motor M. The receiving gear 44 is attached to a punching shaft 42 of each punching member 40 through a later mentioned key mechanism, and transmits rotation to the punching member 40 from a drive means 50.

The cylindrical cam 45 is provided between the punching members 40 and a base frame 31 for converting rotation into the punching direction (upper and lower directions in FIG. 1) with respect to each of the punching members 40.

The drive means 50 is structured with the drive motor M, a drive rotating shaft 52 transmitting rotation of the motor as rotational movement to each of the punching members 40, and the above mentioned cylindrical cam 45 provided between each punching members 40 and base frame 31.

The above mentioned drive motor M is structured with a usually existing normal-reverse rotation motor, and the above mentioned drive means 50 is structured with a driving rotation shaft 52 transmitting rotation of the drive motor M to the plural punching members 40, and drive gears 55 transmitting rotation of this rotation shaft 52 as rotational movement to the punching members 40, and the receiving gear 44 engaging with the drive gears 55.

The relation between the two shafts of the driving rotation shaft 52 and the punching shaft 42 of each punching member 40 forms to be off-set, as seen in FIG. 1, as not crossing and not parallel.

The device in FIG. 1 is structured in a way that the driving rotation shaft 52 and each punching shaft 42 are crossing each other in an orthogonal direction (skew gearing relation).

Therefore, the driving rotation shaft 52 is bearing-supported by side frames 48*a*, 48*b* of a left and right pair composing the base frame 31 (refer to FIG. 1).

The driving rotation shaft 52 is provided at its one end with a bevel gear 46 which engages with a bevel gear 56 for transmitting rotation from a rotating shaft 49 of a drive motor M.

The driving rotation shaft 52 composed enabling normal-reverse rotating motion by the drive motor M and the punching shaft 42 of the plural punching members 40*a* to 40*e* arranged in the relation of the bevel gearing shafts, are connected by the bevel gearing shaft each other, so that rotation of the drive motor M is transmitted to each of the punching members.

The illustrated bevel gears are composed with screw gears, and twist angles of the drive gears 55*a*, 55*b*, 55*c*, 55*d*, 55*e* provided on the driving rotation shaft 52 and twist angles of the receiving gears 44*a*, 44*b*, 44*c*, 44*d*, 44*e* provided on the respective punching members 40*a* to 40*e* are respectively determined to be around 45 degree.

Accordingly, if the driving rotation shaft 52 is rotated clockwise under the condition of FIG. 1, the punching members 40*a* to 40*e* rotate counterclockwise respectively.

The receiving gears (screw gears) 44 and the punching shafts 42 of the respective punching members 40 are mounted as enabling to slide in the punching direction. As shown in FIG. 3, the receiving gear 44 is mounted on the punching shaft 42 of each punching member as movably in the vertical direction, and these receiving gear 44 and punching shaft 42 are engaged by a penetrating pin 43 and an oblong groove 47.

Accordingly, rotation of the receiving gear 44 is transmitted to the punching shaft 42 through the penetrating pin 43, and the punching shaft 42 separates from the receiving gear and is movable in the punching direction along the oblong groove 47.

By the way, the punching shaft 42 mounting under the idle condition in the punching direction and the receiving gear 44 are sufficient with a key—key groove connection other than the oblong groove—pin connection.

The punching members 40 are formed with four, five or other plural number, and in a case of the four holes, the two and four punching holes may be selected, while in the case of five holes, the two and three punching holes may be selected.

The punching shaft 42 of the punching member 40 and the receiving gear 44 are fitted as following. As shown in FIG. 3, the receiving gear 44 is formed with the oblong groove 47 in the punching direction, and this groove is fitted with a cam projection (cam follower) 43 provided in the punching shaft 42.

Therefore, rotation of the receiving gear 44 is transmitted to the punching shaft 42, and the punching shaft 42 rotates integrally with the receiving gear 44, and moves vertically in the punching direction separately from the integrating condition.

Then, since the receiving gear 44 is connected with the driving gear 55, the position in the punching direction is secured and supported by the driving rotation shaft 52 integrally supporting the driving gear 55.

Thus, the present invention is characterized by realizing the pin—slit structure in which the punching shaft 42 is supported rotatably with respect to the device frame 30 and slidably in the punching direction, and the punching shaft 42 is engaged with the receiving gear 44 in the rotating direction and is not engaged in the punching direction.

The driving gear 55 and the receiving gear 44 are disposed in such a manner that the rotation center shafts (o-shaft and p-shaft in FIG. 1) are the off-set relation (not crossing and not parallel).

The device (practicing embodiment) shown in FIG. 1 composes the driving gear 55 and the receiving gear 44 with the screw gears. The driving gear 55 is formed at screwing angle of 45 degree in a +side, while the receiving gear 44 is formed at screwing angle of 45 degree in a—side, and both gears are in mesh in an orthogonal direction.

[Second Embodiment]

Figure 11:
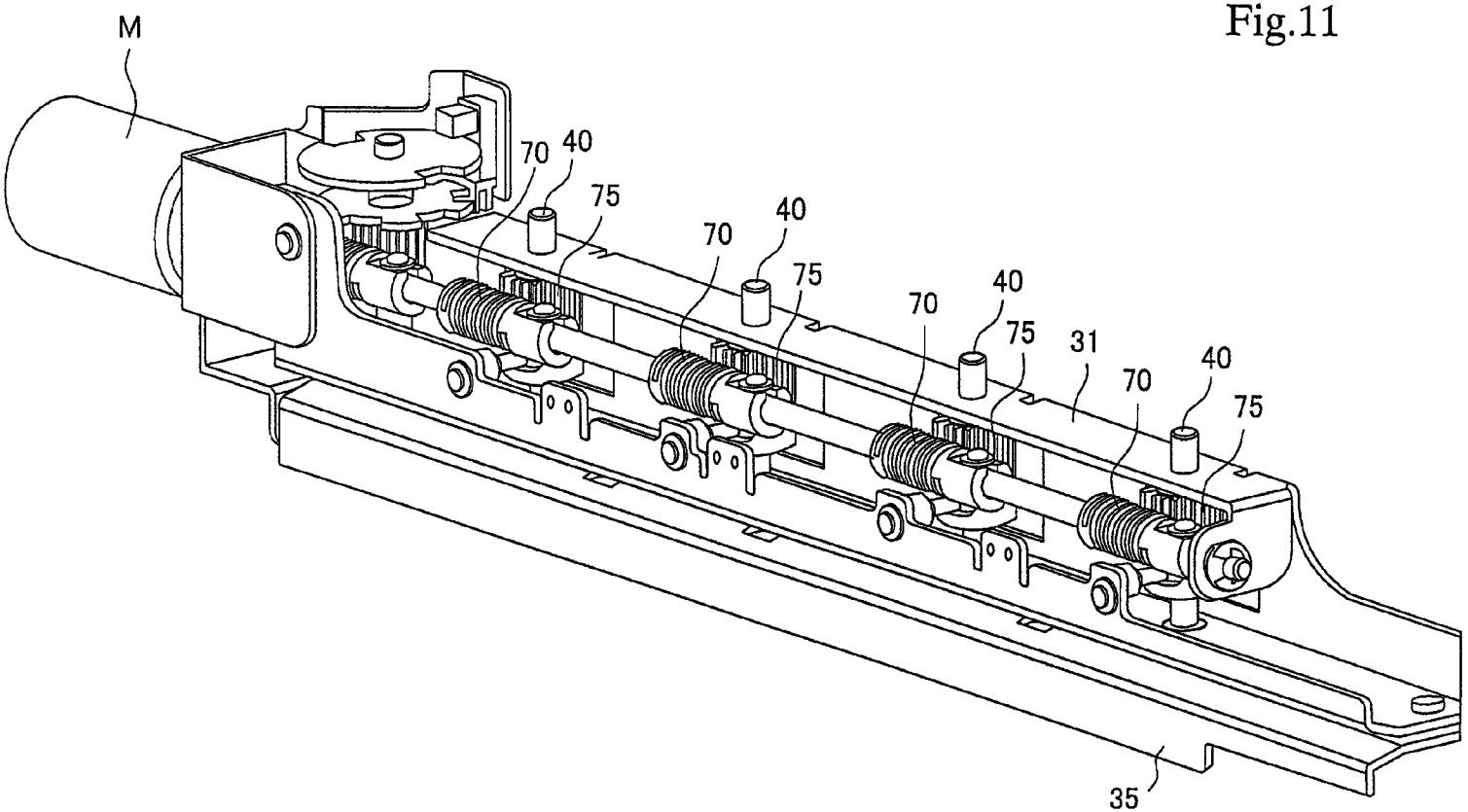
FIG. 11 is a perspective view showing an embodiment different from that of FIG. 1.

With respect to the driving gear 70 and the receiving 75 shown in FIG. 11, the driving gear 70 is structure with the worm gear and the receiving gear 75 is structured with the worm wheel. Although not illustrating, other driving gears and receiving gears may be structured with hypoid gears.

[Cam Mechanism]

The cam mechanism shown in FIG. 3 will be explained. Each of the punching members 40*a* to 40*e* is furnished with a cylindrical cam (cam means) 45 between the punching member 40 and the base frame 31 for changing rotational movement of the punching member to rotation and movement exerting in the punching direction.

The cylindrical cam 45 is disposed between the punching member 40 and the base frame 31 for changing rotation movement of the punching member 40 to moving in the punching direction (vertical directions in FIG. 3) simultaneously with rotation.

Therefore, one of the punching member 40 and the base frame 31 is provided with a V-shaped groove cam 45C, and the other is provided with a cam projection (cam follower) 37.

In the illustrated cam mechanism, the punching member 40 is provided with the cylindrical cam 45 having a V-shaped groove cam 45C, and is provided with a cam projection 37 engaging with the V-shaped groove cam 45C.

The V-shaped groove cams 45C are formed as waveform of angles and valleys along rotating direction of the punching members 40, and the cam projections 37 are composed with pins secured to the frame.

Accordingly, when the punching members 40 rotate clockwise and the cam projections 37 position in the valleys 45×1, the punching members 40 are positioned in waiting positions, and when the cam projections 37 position on the angles 45×2 of the V-shaped groove cams 45C, the punching members 40 are positioned in punching positions.

Figure 6A:
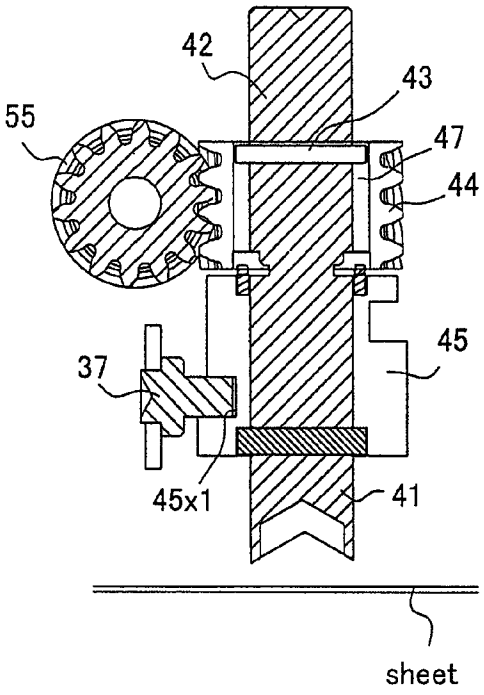
FIGS. 6(*a*)-6(*c*) are explanatory views of the device of FIG. 1, wherein FIG. 6(*a*) shows a waiting condition, FIG. 6(*b*) shows a hole punching condition, and FIG. 6(*c*) is an explanatory view of a cam groove.
Figure 6B:
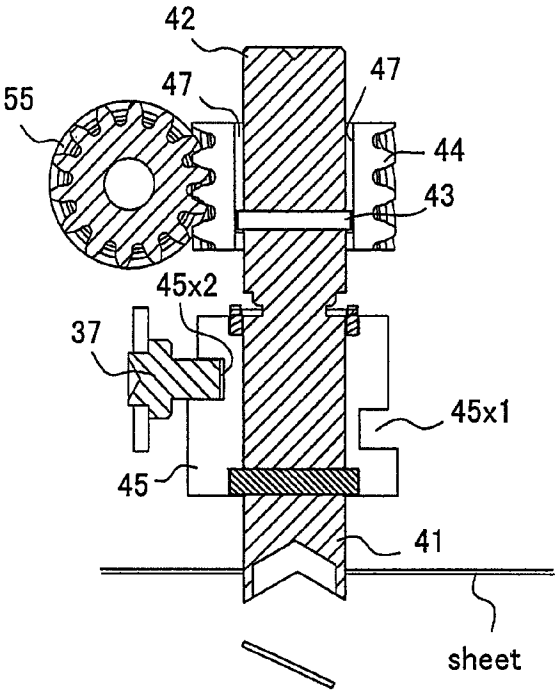
Figure 6C:
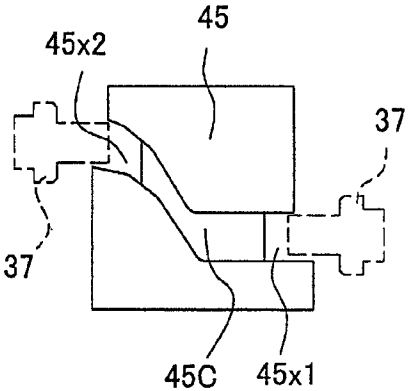

Thus, when the rotation is controlled in such a manner that the punching members 40 position at the cam projections from the home position to the valleys of the V-shaped groove cams 45C, the punching members 40 wait at the upper dead point under a condition shown in FIG. 6(*a*). At this time, the hole punching blades 41 are held under the condition of waiting at the upper dead point with respect to the sheets on the sheet placing frame 35, and this position is set to be the waiting position.

Further, when rotation is controlled in such a manner that the punching members 40 position to the angles of the V-shaped groove cams, the punching members 40 wait at the lower dead point under a condition shown in FIG. 6(*b*). At this time, the hole punching blades 41 are held under the condition of punching holes with respect to the sheets on the sheet placing frame 35, and this position is set to be the hole punching position.

In the illustrated device, for selectively executing t-hole punching (first group) and 3-hole punching (second group), the angle of the cam groove for the first group and that for the second group are differed with respect to rotation angle of the cylindrical cam 45.

For example, at the angle of the cylindrical cam 45 being zero, each of the cam grooves of the first and second groups is set at the waiting position in the valley 45×1, at the angle of the cylindrical cam 45 being 90 degree, the cam groove of the first group is set at the hole punching position in the angle 45×2, and the cam groove of the second group is set at the waiting position in the valley 45×1, and at the angle 180 degree of the cylindrical cam 45, the cam groove of the first group is set at the waiting position in the valley 45×1, and the cam groove of the second group is set at the waiting position in the angle 45×2.

When the cylindrical cam 45 is rotated between 0 and 90 degree, the punching members of the first group begin the punching motion, and the punching members of the second group are held in the waiting position. When the cylindrical cam 45 is rotated between 90 and 180 degree, the punching members of the second group begin the punching motion, and the punching members of the first group are held in the waiting position. By the way, the range of the rotating angle in this case is not limited to and 180 degree, but can be set within 360 degree without restraint.

In the illustrated device, rotation angles of the cam grooves are given phase difference so that, when punching two and three holes, the plural punching members do not punch holes in the sheets at the same time, and in the case of punching two holes, the phase difference of a predetermined angle (e.g., 5 degree) is formed, such that the first punching member go ahead, and subsequently, the second punching member follows. Also in the case of punching three holes, similarly, the angles are determined such that the hole punching is carried out in the order of the first, second and third punching members.

[The Angular Position of Cam Engaging Portion and Gear Engaging Portion]

In this embodiment, when arranging a receiving gear 44 and cam means 45 to each of the punching members 40, the position relationship between the gear engaging member Eg and the cam engaging portion Ec is made as follows.

First, as shown in FIG. 1 (First embodiment) and FIG. 11 (Second embodiment), a plurality of punching members 40 arranged linearly and a driving rotating shaft 52 are arranged in a discrepant relation (non-parallel and non-intersecting axes relationship) in the intersecting direction.

Figure 4:
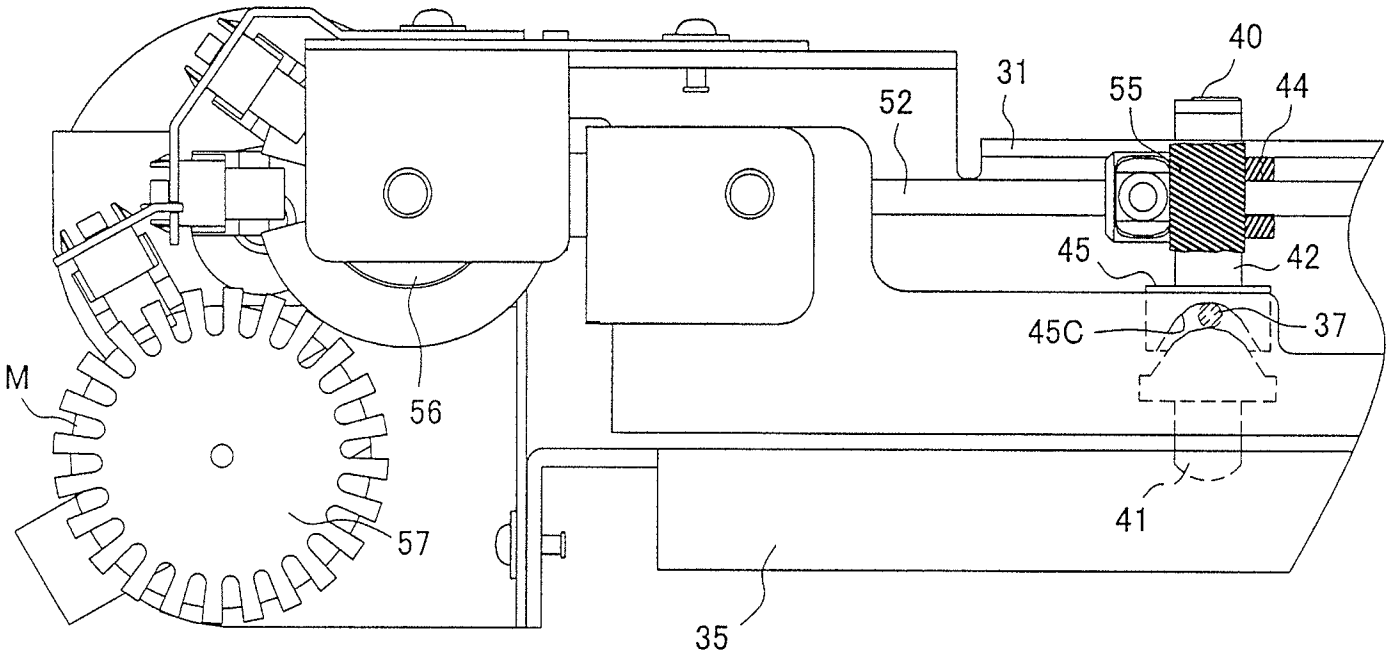
FIG. 4 is a front view showing one part in the device of FIG. 1.
Figure 5A:
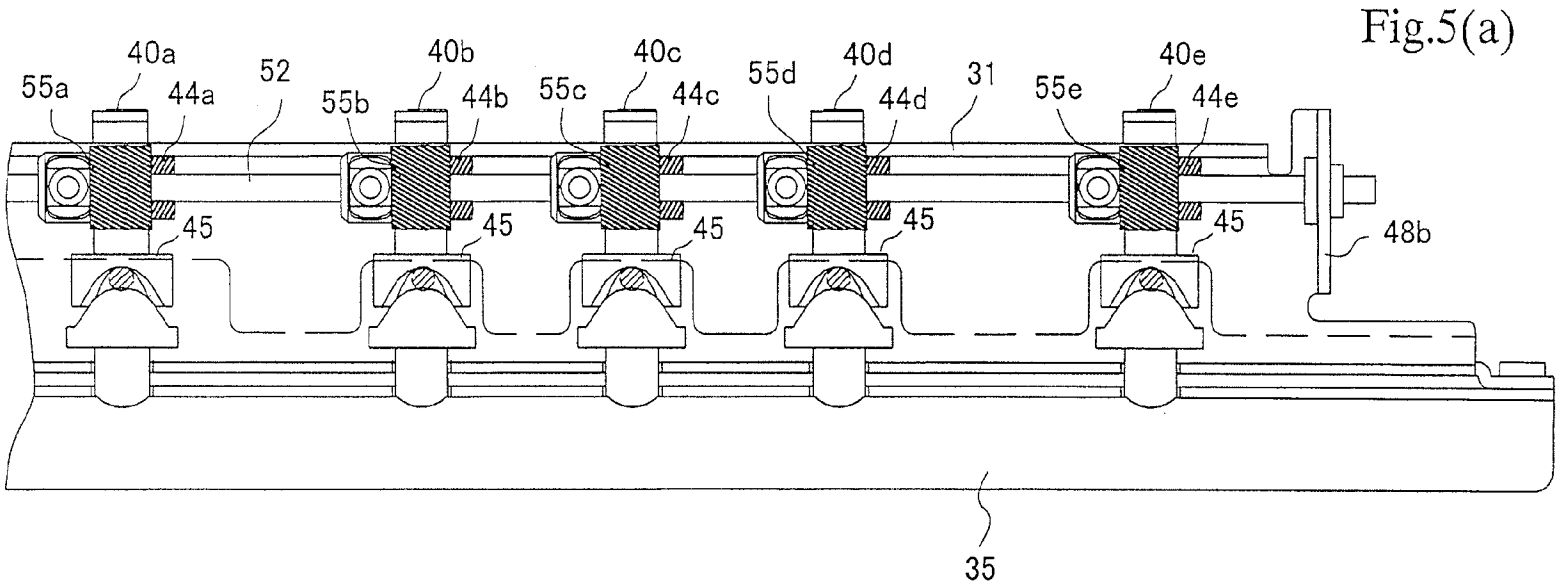
FIG. 5(*a*) is a front view showing one part different from that of FIG. 4 in the device of FIG. 1, and FIG. 5(*b*) to (*d*) showing embodiments of the edge points of the hole punching blades.
Figure 5D:
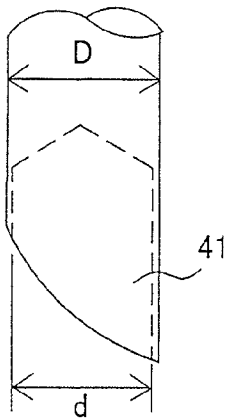
Figure 5C:
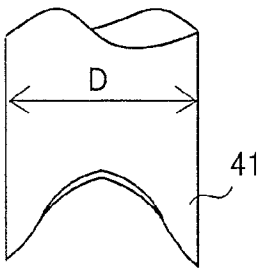
Figure 5B:
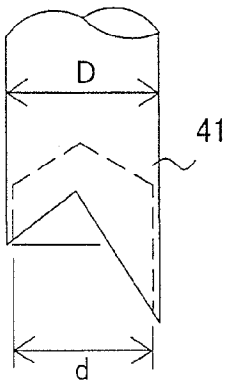

As shown in FIG. 3 to FIG. 5, each of the punching members 40 is provided with the receiving gear 44 engaging with a driving gear 55 disposed on driving rotation shaft 52. The receiving gear 44 and driving gear 55 are structured by the screw gears, and transfer the rotational movement from the rotation of the driving motor to each of the punching members 40.

Although the receiving gear 44 is loosely fitted into rod portion 42 of each of the punching members 40, and the rotation of the gear is transmitted to the rod member 42 with the penetrating pin 43, each of the punching members 40 is vertically moving in the punching direction without restraint (movement regulation) by the receiving gear 44. Therefore, each of the receiving gears 44 is provided with an elongated groove 47 for allowing the pin 43 to move vertically.

Also, in each of the punching members 40 shown in FIG. 3 and FIG. 6, cam means (cylindrical cam) converting a rotating movement to a punching direction movement is arranged at the device frame 30 (upper portion frame 31*a*).

The cam means 45 as shown in the figure is constructed of a V-shaped groove cam 45C formed integrally with each of the punching members 40 and a cam pin 37 (cam follower) fixed to the base frame 31.

In such structure, each of the punching members 40 punches a predetermined number of file holes on the sheet by the operation of the rotational movement from the top dead center to the bottom dead center.

Figure 8B:
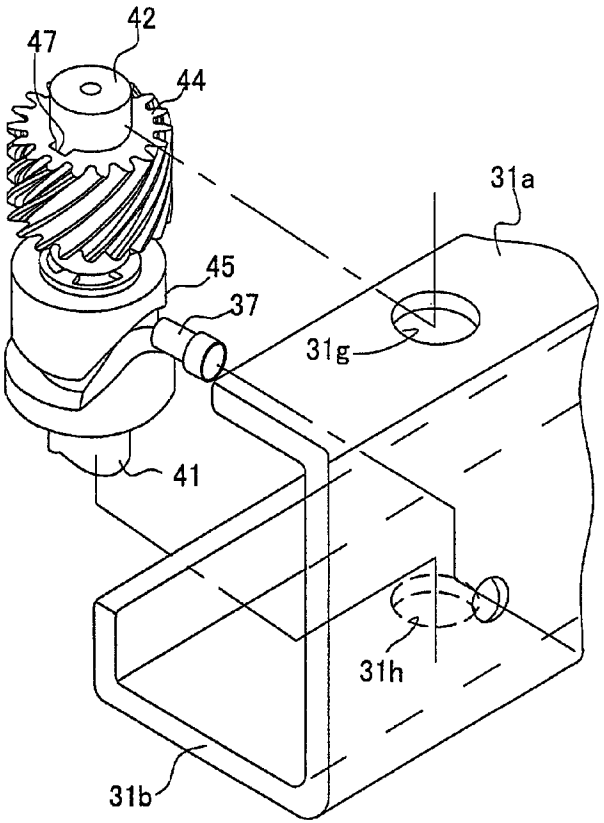
FIG. 8(*a*) is an exploded view of the device of FIG. 1 showing each punching members and frame structure thereof, and FIG. 8(*b*) is an exploded view thereof showing the frame structure in different shape.
Figure 8A:
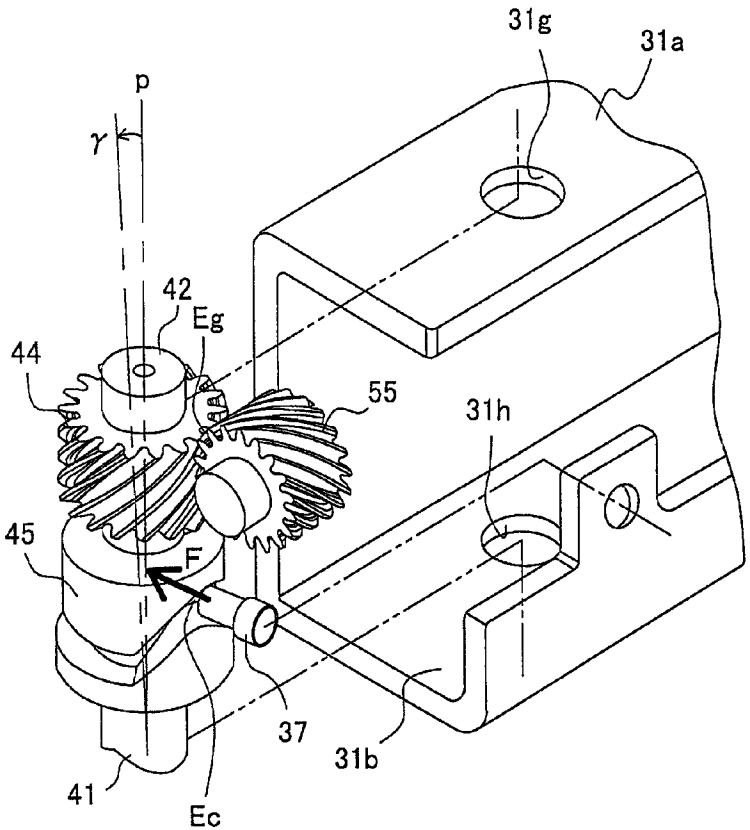
Figure 9:
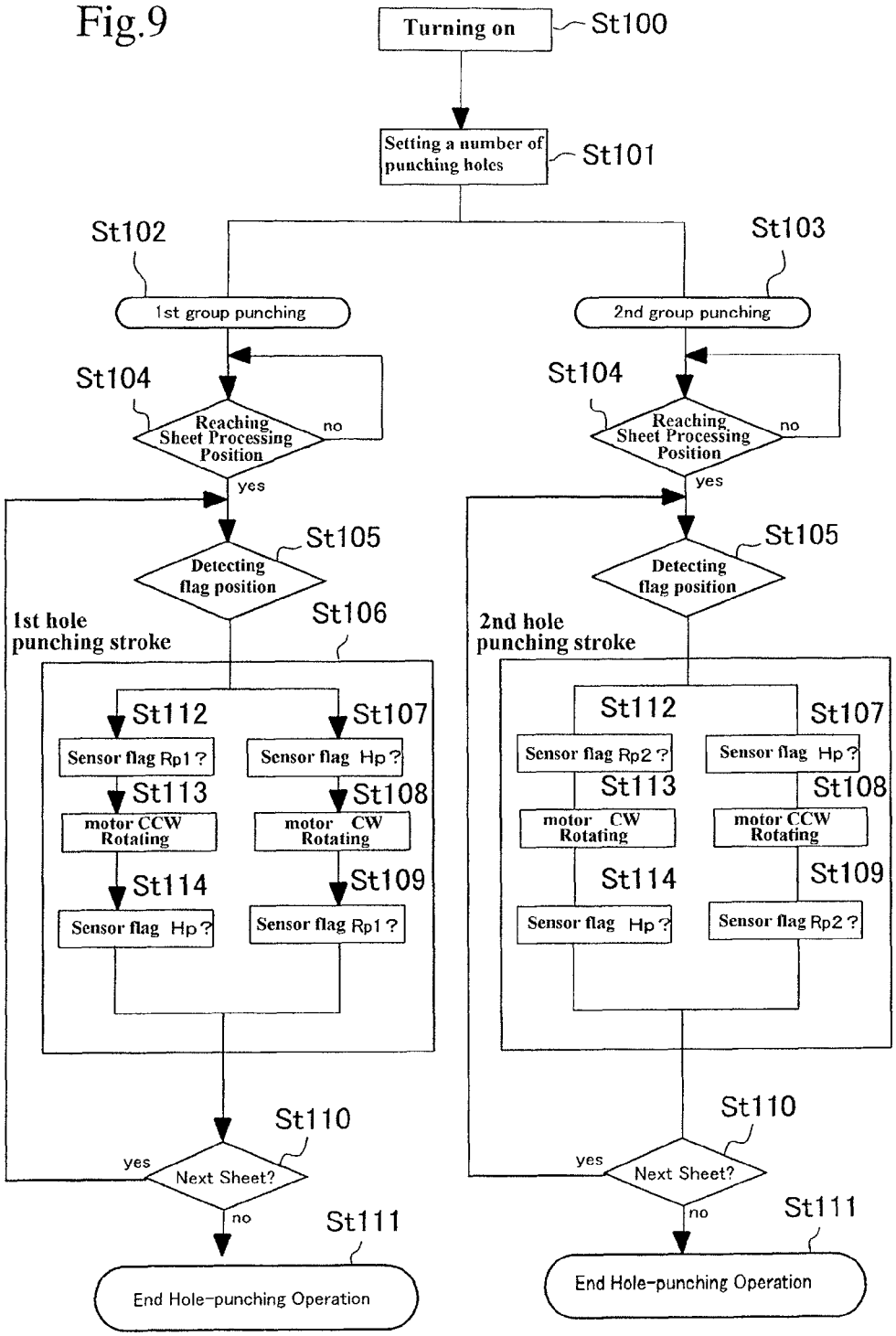
FIG. 9 is a flow chart showing controls of the hole punching device relating to the present invention.
Figure 12A:
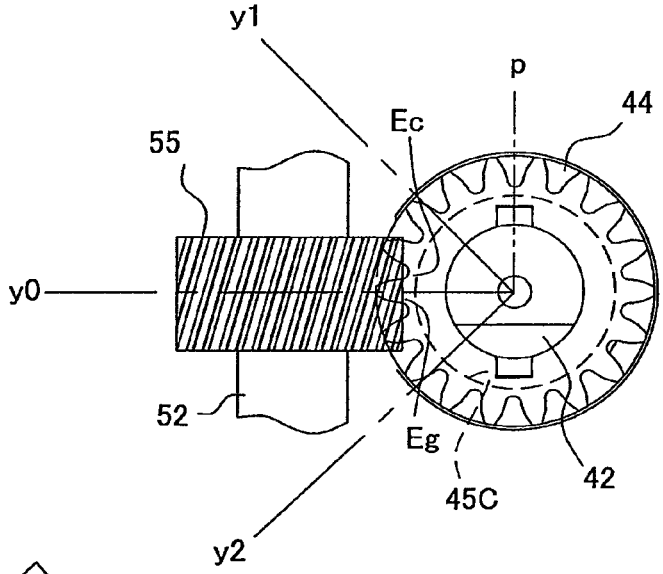
FIGS. 12(*a*) to 12(*c*) are explanatory diagrams showing the angular position relation between a cam engaging portion and a gear engaging portion of each punching member of the device of FIGS. 1 and 11, wherein FIG. 12(*a*) shows the state in which the cam engaging portion and the gear engaging portion are in the identical angular position, FIG. 12(*b*) shows the state in which the angular position is separated at +45° direction.
Figure 12B:
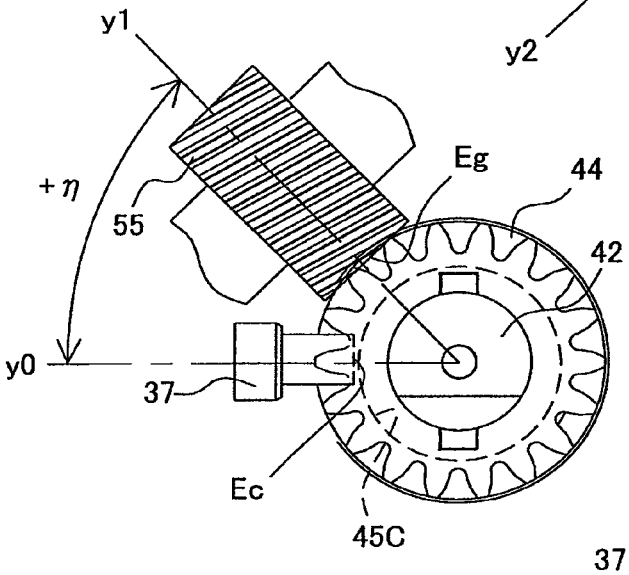
Figure 12C:
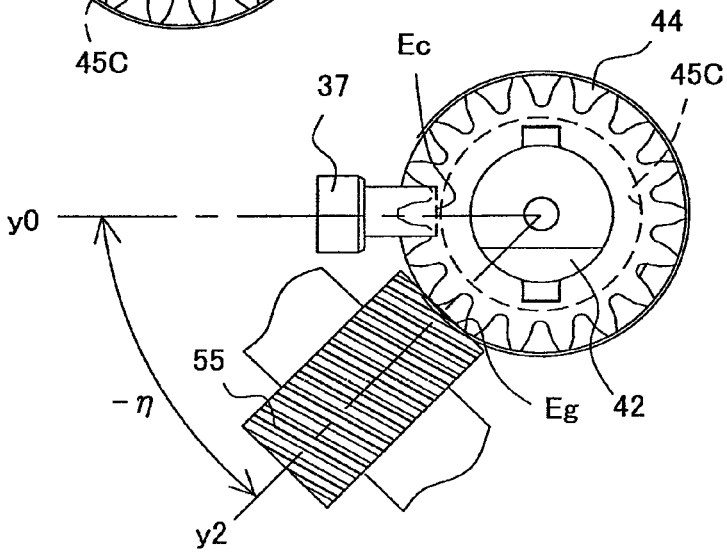

Therefore, as shown in FIG. 8(*a*) and FIGS. 12(*a*)-12(*c*), the gear engaging portion Eg between the receiving gear 44 and the driving gear 55, and the cam engaging portion Ec between the groove cam 45C and the cam pin 37, are positioned at the center (shown as p) of rotating axis of each of the punching members relative to the same direction (shown as p-y0 direction), or within a predetermined angular range ± η (shown as p-y1 direction in FIG. 12(*b*); p-y2 direction in FIG. 12(*c*)).

If a reaction force F acts from the cam pin 37 towards the arrow direction in FIG. 8(*a*) when the angular range (the angular difference between the cam engaging portion and the gear engaging portion) is ± η (η=45 degrees), the axis portion of each of the punching members inclines and warps toward dashed lines in the same figure, for example, at an angle γ.

During this time, the cam engaging portion Ec and the gear engaging portion Eg are set in the range of ± 45 degrees, so backlash between teeth tips are obtained and the rotation of the driving and receiving gear will not be interfered (locking).

FIG. 12(*a*) illustrates when the cam engaging member Ec and the gear engaging Eg are positioned in the identical line (p-y0), and in this state, the gear engaging portion Eg and the cam engaging Ec are positioned at the same angular position.

Also, FIGS. 12(*b*), 12(*c*) show the gear engaging portion Eg and the cam engaging portion Ec set at an angular position varying at 45 degrees. In this case, the punching reaction force F receiving from the cam engaging portion Ec to each punch member acts in direction to disperse the backlash of the gear engaging portion Eg, so a smooth gear drive can be expected.

Figure 7A:
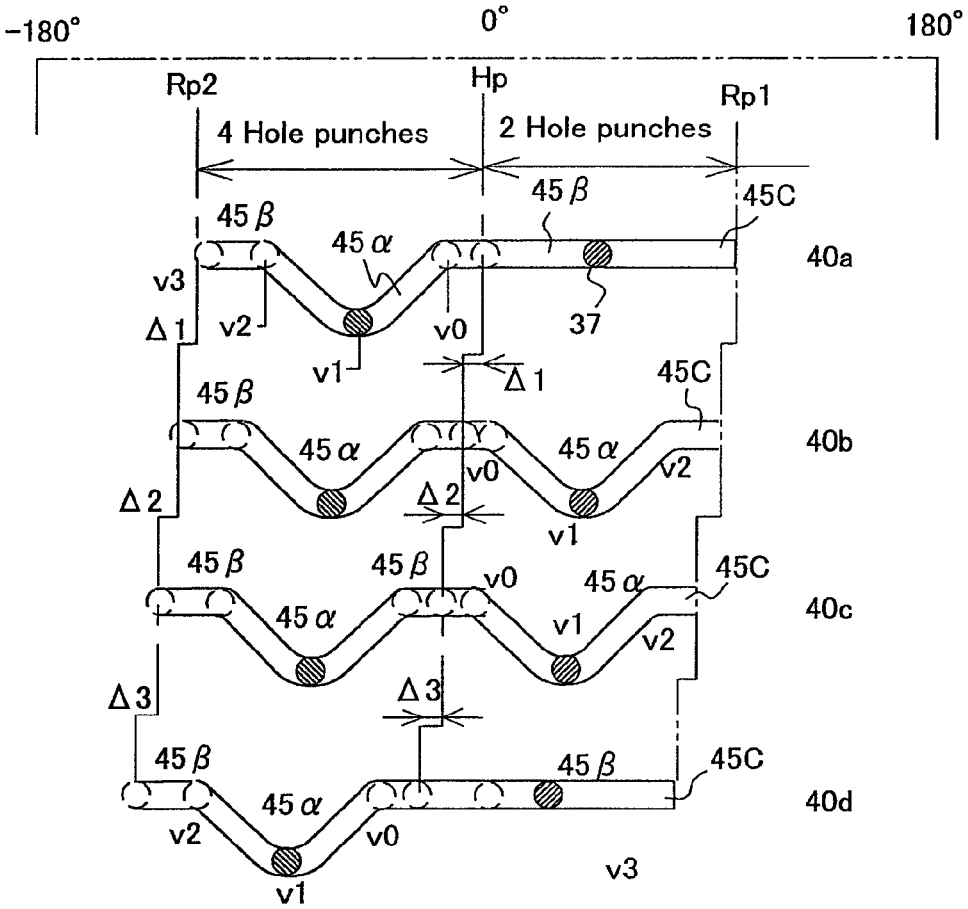
FIG. 7(*a*) shows explanatory views of developing the cam grooves, and FIG. 7(*b*) is an explanatory view of rotational strokes of the drive rotating shaft.
Figure 7B:
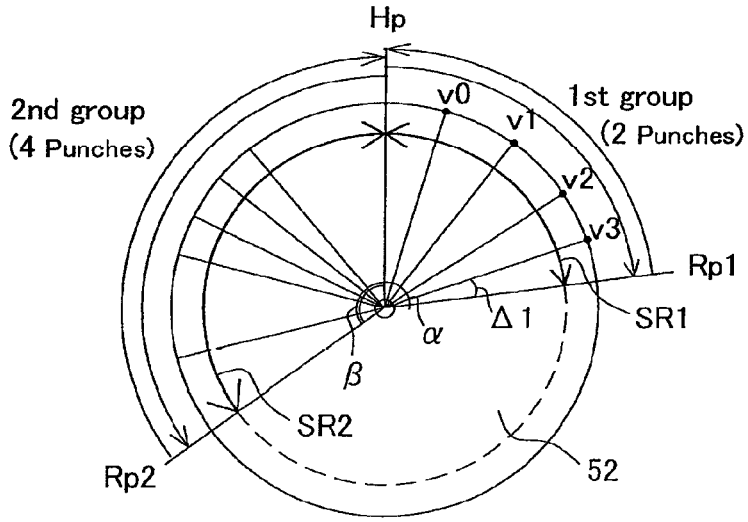

Next, in accordance with FIGS. 7(*a*) and 7(*b*), the cam mechanism will be explained. FIG. 7(*a*) is developing views showing shapes of the V-shaped groove cam 45C formed in the perimeters (inner and outer perimeters) of the cylindrical cam 45. FIG. 7(*b*) is an explanatory view showing rotating strokes of the driving rotation shaft 52.

As having above mentioned, the plural punching members 40 are disposed with the cylindrical cams between each of the punching members 40 and each of the cylindrical cams 45.

These cylindrical cams 45 are furnished with the V-shaped groove cams 45C. The V-shaped groove cam 45C changes motion in a manner of moving the punching member 40 in the hole punching direction at the same time with rotation. Together with it, by presence or absence of the V-shaped groove cam 45C, the punching member 40 is made choose to execute or not the punching motion.

In the following, the relation between the V-shaped groove cam 45C and the driving rotation shaft 52 will be explained with reference to FIG. 7(*b*).

By rotation of the driving rotation shaft 52, each of the punching members 40 rotates, and if the rotating direction of the driving rotation shaft 52 is reversely changed, the rotating direction of the punching member 40 is also changed.

The driving rotation shaft 52 reciprocates in the normal direction (α angle) and in the reverse direction (β angle) within a predetermined rotation range by a later mentioned motor control means 64.

The driving rotation shaft 52 reciprocally rotates at a first hole punching stroke SR1 between a predetermined standard point Hp and a first return position Rp1 as well as at a second hole punching stroke SR2 between the standard point Hp and a second return position Rp2.

At this time, SR1=(Hp−Rp1)=α angle, and SR2=(Hp−Rp2)=β angle.

It is determined that the first hole punching stroke SR1 punches 2 holes in the sheets, and the second hole punching stroke SR2 punches 4 holes in the same. In this determination, it is also possible that the former punches 2 holes, and the latter punches 3 holes.

In the shown device, at a border of the standard point Hp, the first punching hole stroke SR1 is formed in the clockwise direction, while the second punching hole stroke SR2 is formed in the counterclockwise direction.

Explanation will be made to the first punching hole stroke SR1, and since in the second punching hole stroke SR1, the same motion is also carried out, explanation will be omitted.

(Motion of Punching 2 Holes by the 1st Hole Punching Stroke)

A later mentioned motor control means 64 rotates the driving rotation shaft 52 in the rotating direction (clockwise direction) designated in dependence on the punching hole number from the standard point Hp preset by the position sensor.

At this time, the first punching member 40*a* and the fourth punching member 40*d* rotate but do not vertically move (non-hole punching motion).

When the driving rotation shaft 52 rotates, the second punching member 40*b* and the third punching member 40*c* only rotate between the standard point Hp and a shown VO (Hp−V0) and do not move in the punching direction.

Subsequently, each of the punching members gradually goes down concurrently with rotation along an oblique cam face (V-cam face) 45α between VO−V1 by rotation of the driving rotation shaft 52. At V1 when the punching members 40*b*, 40*c* most go down, the hole punching motion to the sheets ends.

The punching members 40*b*, 40*c* rotate from V1 to V2 along the oblique cam face (V-cam face) 45α by rotation of the driving rotation shaft 52 in the same direction, and concurrently go up (returning motion).

When the punching members 40*b*, 40*c* return to the upper dead point, each of the punching members rotates only in the rotating direction and is held there with respect to the hole punching direction.

When the driving rotation shaft 52 is rotated clockwise, the first and fourth punching members 40*a*, 40*d* are maintained at the upper dead points, and the second, third punching members 4 Ob, 40*c* move from the upper dead points to the lower dead points, and return to the upper dead points. At this time, the second, third punching members 40*b*, 40*c* punch holes in the sheets.

Between the second, third punching members 40*b* and 40*c*, delay in time (phase difference Δ2) has been formed, and by this delay in motion, shearing loads of the second, third punching members 40*b*, 40*c* are lightened.

For this case, a later mentioned motor control means 64 rotates the driving rotation shaft 52 clockwise at a predetermined angle α from the standard point Hp, and executes the first hole punching stroke SR1. The driving rotation shaft 52 moves from the standard point Hp to the first return position Rp1. Under this condition, the 2 hole punching is performed in the sheets set on the sheet placing frame 35.

The motor control means 64 rotates counterclockwise the driving rotation shaft 52 and inverts from the first return position Rp1 to the standard point Hp. Then, after the V-groove cam 45C and the cam projection 37 rotate and move from V3 position to V2 position, the punching members 40*b*, 40*c* go down from V2 to V1 along the oblique cam face (V-cam face), and this time, punching motion is carried out.

By continuous rotation of the driving rotation shaft 52, each of the punching members 40 goes upward to the upper dead point and returns to the standard point Hp.

The punching member 40 punches the anticipating sheets, for example, in the clockwise rotation, and punches the following sheets in the counterclockwise rotation.

Therefore, the punched debris is collected in the debris box by converting in terms of the right or left directions.

The present invention differs the stroke lengths of the first and second hole punching strokes SR1 and SR2, because the hole punching loads are different depending on the punching motion of the more punching number and that of the less punching number.

Therefore, the first hole punching stroke SR1 of the less punching load is set to be shorter than the second hole punching stroke SR2 of the more punching load. Thus, the shown angles $\alpha$ and $\beta$ are set to be the angle $\alpha <$ the angle $\beta$.

[Explanation of Motion]

The above structure will be explained concerning its function. The punching members 40 are composed of four pieces, five pieces or other plural pieces, and the punching members 40 are disposed at a predetermined distance in a straight line.

Each of the punching members 40 is supported reciprocally in the punching direction to the device frame 30, and is composed to have a punching shaft 42 shaped in shaft circle in cross section.

The punching shaft 42 is fitted and supported in an upper bearing hole 31*g* and a lower bearing hole 31*h* of the base frame 31, and is held reciprocally in the vertical directions (punching direction) in cross section of FIG. 3.

Together with it, each of the punching members 40 is supported rotatably in the upper bearing hole 31*g* and the lower bearing hole 31*h*.

The punching members 40 are provided at front ends with hole punching blades, and the respective hole punching blades are sharp, and U-shaped, V-shape or skew in cross section, and they are shearing-edges in any of right and left rotations of the punching members 40.

Each of the punching members 40 is disposed with the receiving gear 44 for transmitting rotating motion and the cam means 45 for generating linear movement in the punching direction from the rotating motion. The receiving gear 44 is composed with a skew gear such as a worm gear, screw gear or hypoid gear.

The device frame 30 is disposed with the upper bearing hole 31*g* for bearing the punching member and the driving rotation shaft 52 at the central position of the lower bearing hole 31*h* in the bevel gearing relation.

The plural driving gears 55 are securely provided on the driving rotation shaft 52, and are placed in opposition to the receiving gears 44 of the plural punching members 40. With regard to the driving gears 55 and the receiving gears 44, in the case of the shown screw gear structure, the driving gears 55 are structured at a predetermined twist angle in a +side, and the receiving gears 44 are structured at a predetermined twist angle in a −side, and both gears are in mesh in the orthogonal direction.

Each of the receiving gears 44 is mounted on the punching shaft 42 of each of the punching members 40 movably in the punching direction and engages with the driving gear 55, and each punching member 40 is movable in the punching direction with respect to the receiving gear 44 engaged and positioned with the driving gear 55.

On the other hand, in regard to the cylindrical cam 45 between each of the punching members 40 and the device frame 30, the cylindrical cam 45 is integrally formed to the punching member 40 in the illustrated embodiment. The punching shaft 42 of the punching member 40 is composed with a hard metal, and the cylindrical cam 45 is resin-molded. Therefore, when forming the resin cylindrical cam, the punching shaft is insert-molded integrally therewith.

To explain this condition in accordance with FIG. 6, the punching member 40 at the waiting position of FIG. 6(*a*) is angularly adjusted in a position where the valley 45×1 of the V-shaped groove cam 45C of the cylindrical cam 45 engages with the cam projection 37.

Under this condition, the punching member 40 is regulated in height by the cam projection 37, and the hole punching blade 41 waits at a position retreating upward from the sheet of the sheet placing frame 35.

Next, the hole punching condition of the punching member 40 will be explained. Under the above mentioned waiting position, a control means 60 of the device (such as control CPU) rotates the drive motor M and drives a motor rotating shaft 49 and the driving rotation 52 connecting thereto in a predetermined direction.

In the shown embodiment, a rotation of the motor rotating shaft 49 is transmitted to the driving rotation shaft 52 by the bevel gear (driving gear) 46. By rotation of the driving rotation shaft 52 in the predetermined direction, the plural driving gears 55 rotate integrally with the shaft, and cooperate with the receiving gears 44.

By the rotation of the receiving gear 44, the punching members 40 rotate in the same direction as that of the gear. This rotating power is given by a penetrating pin 43 connecting the receiving gears 44 and the punching shaft 42 of each punching member 40.

The punching member 40 moves its position from the waiting position of FIG. 6(*a*) to the hole punching position of FIG. 6(*b*) by the cylindrical cam 45 formed integrally with the punching member 40 and the cam projection 37.

Under the waiting condition of FIG. 6(*a*), the angles of the punching members 40 are set in different positions when punching the 2 holes and punching the 3 holes. For example, from a home position (zero angle) to a first angle position ("a" degree), the angle is set at the waiting position of the 2 hole punching, and at a second angle position ("b" degree; a<b), the angle is set at the waiting position of the 3 hole punching.

Figure 2:
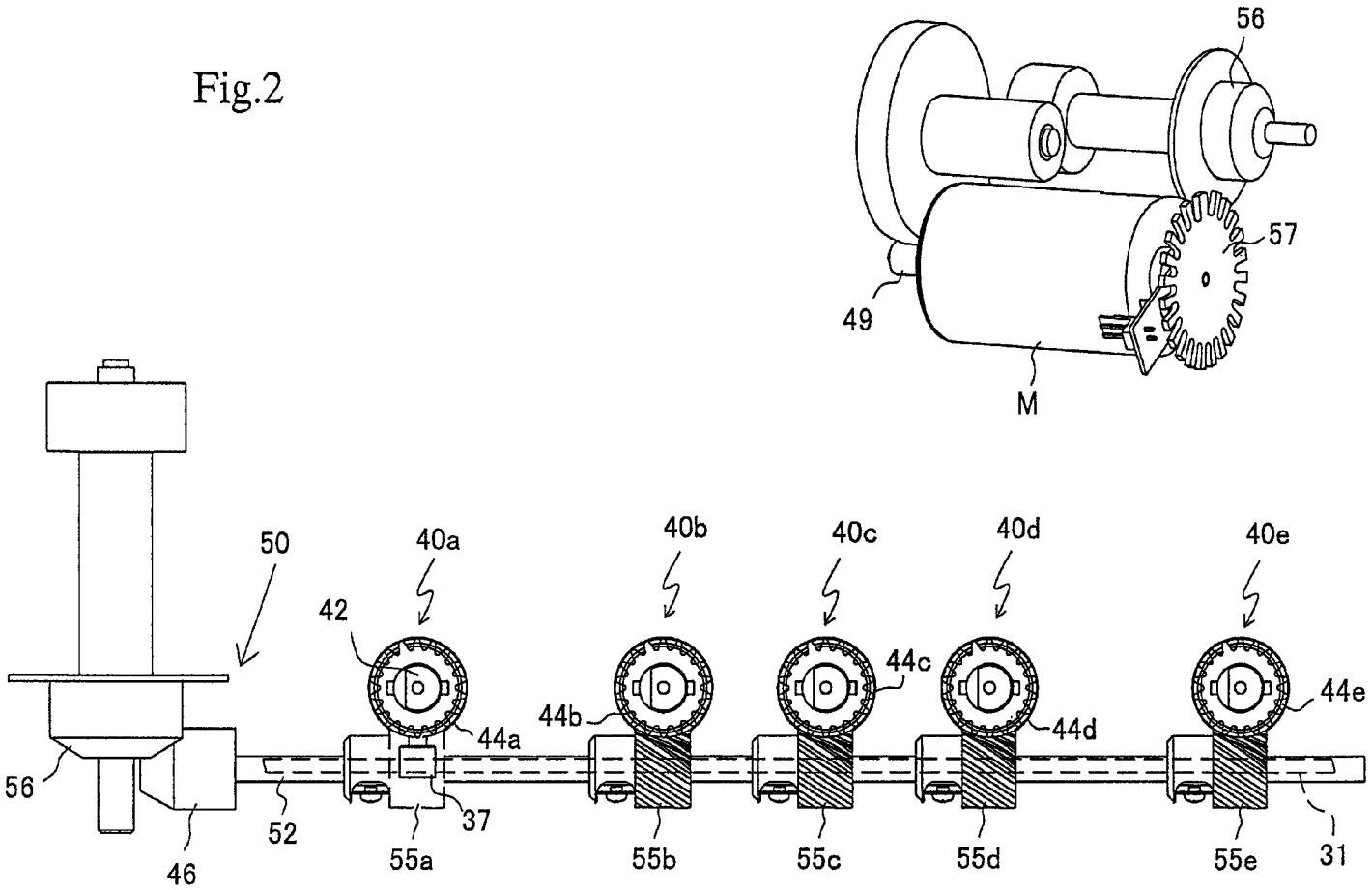
FIG. 2 is an explanatory view of an elementary part showing a transmission system of a rotation shaft and punching members in the device of FIG. 1.

The structure of the drive motor M will be explained in accordance with FIGS. 2 and 4. In the shown device, the drive motor M is supported to the device frame 30. The motor rotating shaft 49 is furnished with an encoder 57 counting rotation number (rotation angle) of the rotating shaft.

The drive motor M is electrically connected to a not shown drive circuit for enabling PWM control. Sufficiently, the drive motor is composed with a stepping motor to affect PWM control.

[Hole Punching Flow]

In the above explained device structure, the hole punching operations of 2 or 4 holes are performed as follows.

When turning ON the power source of the device, the driving rotation shaft 52 is moved to the home position for initializing operation (St100). This moving judges whether or not a flag sensor is turned ON, and until the sensor becomes ON, the drive motor M is rotated.

Next, a motor control means 64 determines a number of punching holes (St101). This is to determine to cause the punching member 40A of a first group to punch holes (St102), or to cause the punching member 40B of a second group to punch holes (St103).

Subsequently, the motor control means 64 detects whether or not the sheets reach an initial position by means of a not shown sheet sensor (St104). When the sheets are set at the initial position, the motor control means 64 distinguishes the flag position of the driving rotation shaft 52 (St105). This flag position is determined to be set at any one of the home position, the 1st return position Rp1 and the 2nd return position RP2, and is structured to count which position it is.

Then, when the motor control means 64 confirms the sensor flag positioning at the home position (St107), the motor control means 64 selects a first hole punching stroke SR1 of the first group punching member 40A, and rotates the drive motor M in CW direction from the standard point Hp (St108). Other operations are the same as those of the first hole punching operation, and explanations will be omitted.

The driving rotation shaft 52 is rotated clockwise to rotate the drive motor until the sensor flag positioning the standard point Hp reaches the first return position Rp1 (St109). This driving rotation of the drive motor M rotates at the pulse number predetermined when the sensor flag positions at the home position Hp, and at the same time, it operates an electric brake when the predetermined pulse passes, and is set such that the returning position of the sensor flag turns ON.

Then, the motor control means 64 detects whether or not a following sheet exists (St110). When the following sheet does not exist, it finishes the hole punching operation (Still), and when the following sheet exists, it discriminates the position of the sensor flag. When the sensor flag positions at the first return position Rp1 (St112), the motor control means 64 rotates counterclockwise (CCW) the drive motor M (St113), and rotates until the sensor flag returns the standard point Hp (St114).

Otherwise, when this position detection shows the sensor flag being at the standard point Hp, the motor control means 64 rotates the drive motor clockwise (CW), and rotates until the sensor flag comes to the first return position Rp1. The rotation control at this time of the drive motor M is the same as having above explained.

Thus, the rotating direction is reversed such that the precedent sheet is in the clockwise direction (CW), and the subsequent sheet is in the counterclockwise direction (CCW).

When selecting the second hole punching stroke SR2, the motor control means 64 rotates CCW (counterclockwise direction) the driving rotation shaft 52 from the standard point Hp, and returns at the second hole punching stroke SR2. The control of the drive motor M is the same as that of the punching stroke SR1.

At this time, the driving rotation shaft 52 reciprocates between the second return position Rp2 shown in FIG. 7(*b*) and the standard point Hp.

[Controlling Structure]

Figure 10:
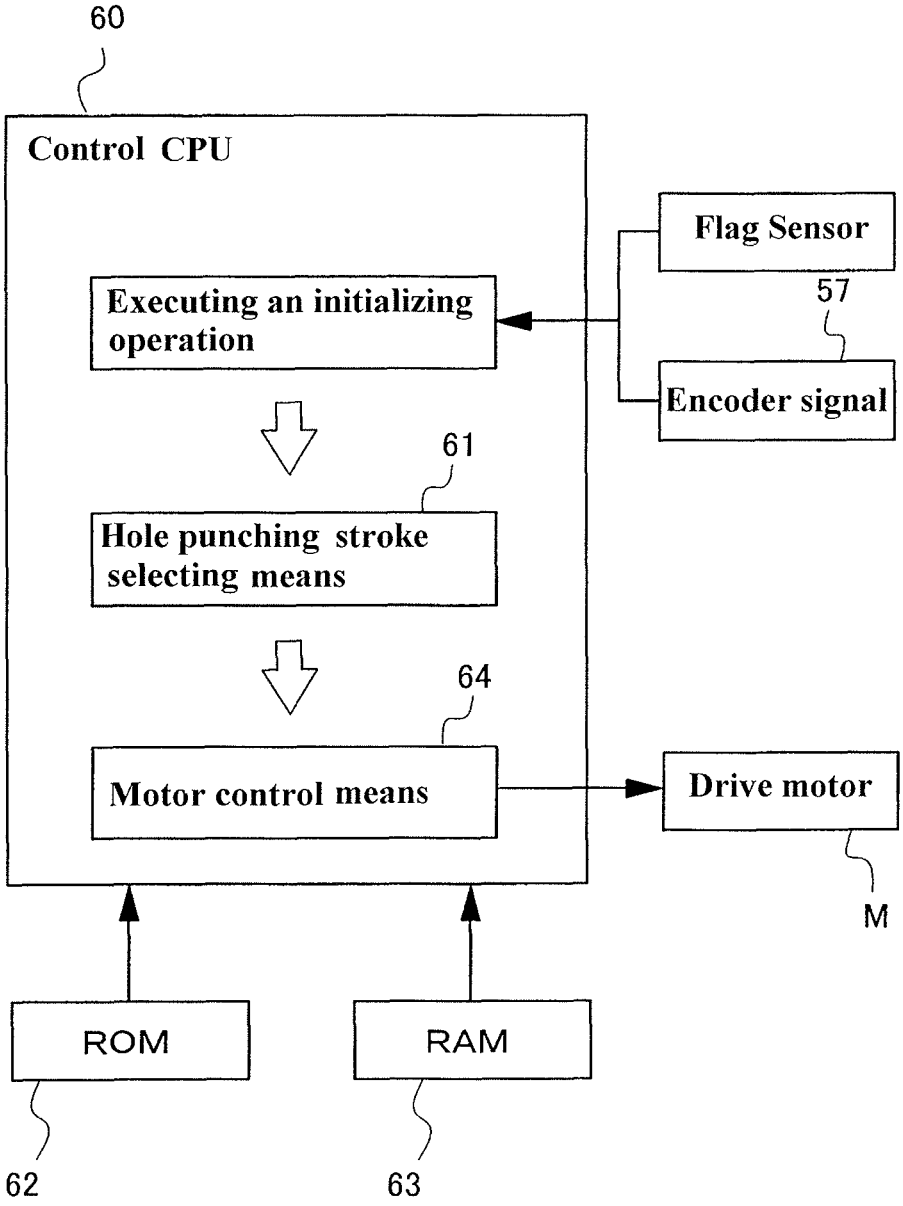
FIG. 10 is a block diagram showing controls in the device of FIG. 1.

FIG. 10 shows a controlling structure of the device of FIG. 1. The controlling structure is composed of, for example, a control CPU 60, and a hole punching stroke selecting means 61 is composed from a not shown control panel. The control CPU 60 executes an initializing operation and a hole punching operation in accordance with the program of ROM 62 and the control data of RAM 63.

The hole punching stroke selecting means 61 recognizes the hole punching number selected by an operator, and based on its result, a motor control means 64 controls the drive motor M.

To the control 60, a detecting signal of the flag sensor and a detecting signal of the encoder 57 are transmitted from an encoder sensor 57S. Besides, a detecting signal of a jam detecting means is sent.

[Explanation of Post-Treating Device]

Figure 13:
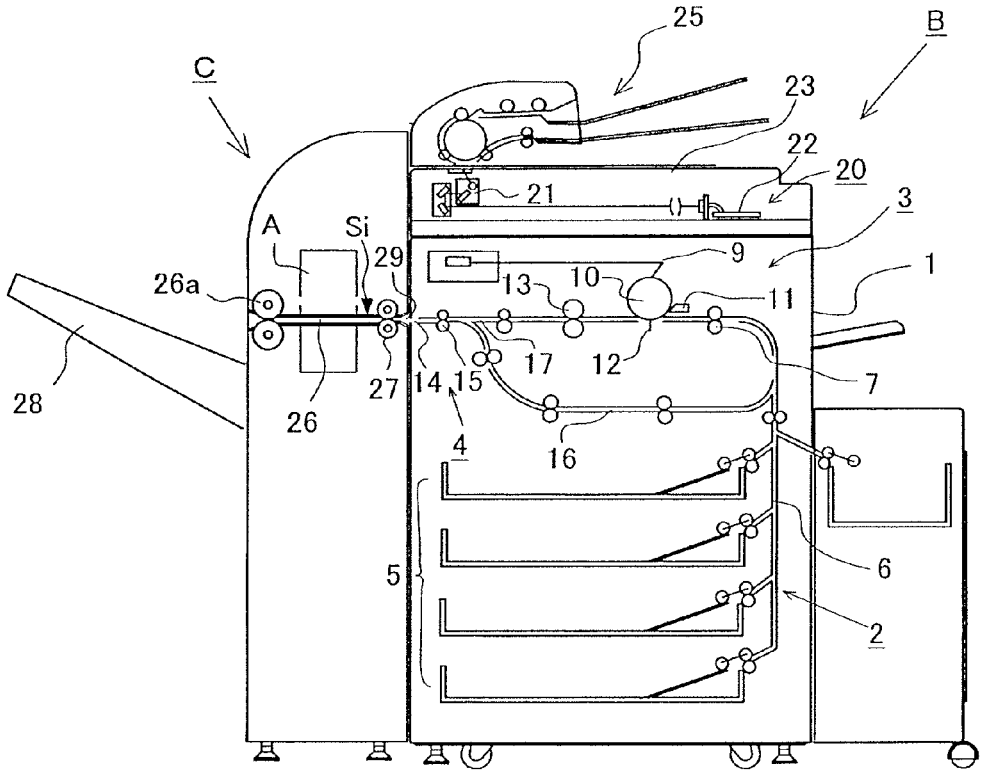
FIG. 13 shows a post-treating device in an image forming system building-in the device of FIG. 1 or FIG. 11.

Next, the structure of a post-treating device C in an image forming device B relating to the present invention will be explained referring to FIG. 13. The image forming system is composed of the image forming device B of performing printings in succession on the sheets and the post-treating device C provided at a downstream side of the image forming device B.

The sheets formed with images in the image forming device B are performed with the hole punching treatment in the post-treating device C.

Firstly, the image forming device B may employ many kinds of structures such as a copier, printer or printing machine, and the illustrated device shows an electrostatic printing device. This image forming device B is built in a casing 1 with a sheet feeding part 2, a printing part 3, a sheet outlet 4, and a controlling part (not shown).

The sheet feeding part 2 is prepared with plural cassettes in response to sheet sizes, and the sheets having sizes indicated by the controlling part are drawn out into a sheet feeding path 6. This sheet feeding path 6 has resist rollers 7 and feeds the sheets of justified front ends to the printing part 3 positioned at the downstream.

The printing part 3 has an electrostatic drum 10, and around the drum 10, there are displaced a printing head 9, a development unit 11, a transferring charge 12 and others. The printing head 9 is composed of, e.g., a laser photogenic organ, and an electrostatic latent image is formed on the electrostatic drum 10. This latent image is adhered with a toner ink by a development unit 11, and printed on the sheets by a transfer charger 12.

These printed sheets are fixed by a fixing unit 13 and transferred into a discharging path 17. At the sheet outlet 4, there are a sheet discharging mouth 14 formed in the casing 1 and sheet discharging rollers 15.

Incidentally, numeral 16 represents a circulating path, which turns reversely the printed sheets from the discharging path 17 in a switch-back path, and after then sends again them to the resist rollers 7 for forming images on the reverse faces of the printed sheets. The printed sheets on one side or both sides are discharged by the discharging rollers 15 from the sheet outlet 14.

Numeral 20 represents a scanner unit of optically reading images on a document image to be printed by the printing head 9. The structure is, as generally known, made of a platen 23 for placing and setting the document sheets thereon, a carriage 21 for scanning the document image along the platen 23 and an optically reading means (for example, CCD device) 22 for photoelectrically converting an optical image from the carriage 21. The illustrated unit is furnished, on the platen 23, with an document feed device 25 automatically sending the document sheets to the platen.

The post-treating device C is connected to the sheet outlet 14 of the image forming device B. The post-treating device C is composed of a sheet transferring path 26, a punch unit A disposed to the sheet transferring path 26, and a sheet discharging stacker 28. The sheet transferring path 26 is provided with a registering means 27 at an upstream side of the punch unit A for registering the sheets at the rear ends.

The sheet transferring path 26 is arranged with reciprocally rotating rollers 26*a* for tossing the sheets from an inlet 29 to the registering means 27, and at the same time, the reciprocally rotating rollers 26*a* transfer the sheets from the punch unit A to the sheet discharging stacker 28. "Si" represents a sheet detecting sensor.

The punch unit A is composed of the device shown in FIG. 1 having been explained before.

The thus composed post-treating device C receives the printed sheets from the inlet 29 of the image forming device B, detects the sheets at the rear ends by the sheet detecting sensor Si, and reverses (shown counterclockwise direction) the reciprocally rotating rollers 26*a* at a timing of passing the rear ends of the sheets at the registering means 27. Then, the sheets are switched back and the sheets collide at the rear ends the registering means 27 and registered.

After having registered, the reciprocally rotating rollers 26*a* stop and hold the sheets at this position. Under this condition, the punch unit A drives the drive motor M to execute the above mentioned hole punching operation. After the hole punching operation, the reciprocally rotating rollers 26*a* is rotated clockwise by the ending signal from the position sensor to transfer the punched sheets to the sheet discharging stacker 28.

By the way, the post-treating device C is incorporated with a staple unit, a stamp unit, and other in response to a device specification, although they are not illustrated.

What is claimed is:

1. A sheet hole punching device for punching holes in a sheet, comprising:

a plurality of punching members;

a device frame supporting the plurality of punching members thereon linearly to vertically and slidably move the punching members in a hole punching direction;

a driving rotation shaft disposed in a direction crossing with the punching members;

a drive motor reciprocally rotating the driving rotation shaft within a predetermined angular range;

a gear mechanism attached to the driving rotation shaft for transmitting a rotation of the driving rotation shaft as a rotational movement to the punching members;

cam mechanisms attached to the punching members for converting the rotational movement of each of the punching members into a vertical movement in the punching direction at a same time of the rotation; and a motor control device to control the drive motor, wherein the gear mechanism includes drive gears fixed on the driving rotation shaft, and receiving gears engaging the drive gears to transmit a rotational movement to the punching members, and each of the cam mechanisms includes a cylindrical cam formed integrally to the punching member and having a V-shaped groove, and a cam follower fixed to the device frame and engaging the V-shaped groove, the cam mechanism reciprocating each of the punching members between an upper dead point and a lower dead point with respect to rotation thereof within a predetermined angular range.

2. A sheet hole punching device according to claim 1, wherein the motor control device drives the rotating shaft in forward and reverse directions for continuously punching holes so that the punching members are rotated in the forward direction to punch holes in a sheet, and subsequently rotated in the reverse direction to punch holes in a subsequent sheet.

3. A sheet hole punching device according to claim 1, wherein the device frame is formed in a channel shape, each of the punching members being supported to an upper frame and a lower frame having a predetermined space in the punching direction for sliding, and the cylindrical cam and the driving rotation shaft are vertically disposed between the lower frame and the upper frame.

4. A sheet hole punching device according to claim 1, wherein the drive gear and the receiving gear comprise screw gears engaging with each other, the drive gear is fixed on the drive rotating shaft rotatably supported to the device frame, and the receiving gear is supported in the hole punching direction by engaging with the drive gear.

5. A sheet hole punching device according to claim 1, wherein the plurality of punching members is divided into first and second groups, the driving rotation shaft is set with a first hole punching stroke causing the punching members of the first group to punch holes and with a second hole punching stroke causing the punching members of the second group to punch holes, and the first hole punching stroke and the second hole punching stroke are set within angular ranges where the first and second hole punching strokes rotate in directions opposite to each other at standard points in advance determined in the driving rotation shaft.

6. A sheet hole punching device according to claim 5, wherein the first hole punching stroke and the second hole punching stroke have different stroke lengths according to a number of punching holes, and length of the stroke with more hole punching number is longer than the length of the stroke with less hole punching number.

7. A sheet hole punching device according to claim 1, wherein a gear engaging portion between the receiving gear and the driving gear, and a cam engaging portion between the groove cam and a cam pin, are positioned with respect to a center of a rotating axis of the punching member at a same angular position or within an angle range of 45 degrees.

* * * * *